US006016420A

United States Patent [19]

Janssens et al.

[11] Patent Number: 6,016,420

[45] Date of Patent: Jan. 18, 2000

[54] ELECTROSTATIC TRANSPORT SYSTEM FOR TONERED SHEETS

[75] Inventors: Robert Janssens, Geel; Werner Heirbaut, Sint Niklaas; Luc Van Goethem, Sint-Gillis-Waas; Peter Baeyens, Melsele; Frank Trouillard, Lint, all of Belgium

[73] Assignee: Agfa-Gevaert, Mortsel, Belgium

[21] Appl. No.: 09/040,056

[22] Filed: Mar. 17, 1998

[30] Foreign Application Priority Data

Mar. 17, 1997 [EP] European Pat. Off. ..... 97200790

[51] Int. Cl.[7] ..... G03G 21/00

[52] U.S. Cl. ..... 399/397; 399/400

[58] Field of Search ..... 399/303, 312, 399/313, 314, 397, 297, 306, 400, 170, 307; 271/18.1

[56] References Cited

U.S. PATENT DOCUMENTS

| | | | |
|---|---|---|---|
| 3,832,053 | 8/1974 | Goel et al. | 399/312 |
| 4,128,328 | 12/1978 | Matsui | 399/268 |
| 4,369,729 | 1/1983 | Shigenobu et al. | 399/320 X |
| 4,427,285 | 1/1984 | Stange | 399/306 |
| 4,745,435 | 5/1988 | Sakata et al. | 399/400 X |
| 5,009,352 | 4/1991 | Yasuda et al. | 226/94 |
| 5,045,892 | 9/1991 | Morisawa et al. | 399/400 |
| 5,050,859 | 9/1991 | Paxon | 271/270 |
| 5,255,904 | 10/1993 | Taguchi et al. | 271/181 |
| 5,268,725 | 12/1993 | Koga et al. | 399/312 |
| 5,485,257 | 1/1996 | Ueda et al. | 399/313 X |
| 5,666,621 | 9/1997 | Maekawa et al. | 399/303 |
| 5,722,012 | 2/1998 | Saitoh | 399/400 X |
| 5,822,665 | 10/1998 | Yamamoto et al. | 399/303 |
| 5,890,046 | 3/1999 | Amemiya et al. | 399/312 X |

OTHER PUBLICATIONS

Platt, Albert; Dec. 1977; "Electrostatic Transport for Unfused Copies"; Research Disclosure; No. 164, pp. 28–29.

*Primary Examiner*—Susan S. Y. Lee
*Attorney, Agent, or Firm*—Baker & Botts, L.L.P.

[57] ABSTRACT

A system is described for transporting sheet-like material. The sheet has a powder, such as electrographic toner particles, loosely attached to it at one or both sides. The particles may be laid down in an image-wise manner by an electrophotographic or direct electrographic system, such as a printer or a copier. The sheet is transported by an endless belt or by a drum. In order to preserve the location of toner particles on the sheet, and to establish correct transportation of the sheet, electrostatic charges are applied either to the sheet or the transporting member or both. As such, the sheet suitably adheres to the transport system and electrostatically loaded toner particles may even adhere better to the sheet.

16 Claims, 2 Drawing Sheets

ELECTROSTATIC TRANSPORT SYSTEM FOR TONERED SHEETS

FIELD OF THE INVENTION

The present invention relates to a transport system, capable of transporting a sheet-like receptor support that may hold a toner image at both sides; this transport system can be used within an electrographic copying or printing apparatus.

BACKGROUND OF THE INVENTION

It is nowadays becoming possible to make images of near offset quality, especially colour images, using non-offset printing techniques, such as electrophotography. In duplex printing, such an image is made on both sides of a receptor support, such as a paper sheet.

In an electrophotographic apparatus, highest throughput in duplex printing on pre-cut sheets is obtained by making both images in a single pass through the subsequent stations in the apparatus—these stations are described in more detail below. Such single pass duplex printing requires transporting a sheet holding a toner image at both sides, since initially, after both toner images are made and transferred to the sheet, the images are adhering only loosely to the sheet. They can easily be removed, e.g. by rubbing or by a slight contact. Only in the next processing step, in the fusing station, the images are permanently fixed onto the sheet.

The problem of transporting a sheet holding an unfixed double-sided toner image also exists, when this image is obtained using other electrographic systems. In direct electrostatic printing, for example switchable aperture electrodes image-wise regulate the toner transfer through the printhead to the sheet. Also in this case, single pass processing of duplex images requires transporting a receptor support holding a double-sided unfixed toner image to a fusing station.

U.S. Pat. No. 4,427,285 describes a single pass duplex reproduction system having a heat insulating prefuser transport device. In particular, the prefuser transport is a pair of cold, toner compacting rolls.

A drawback of the system disclosed there is that it requires a film of release agent to be deposited onto the compacting rolls, to prevent toner offsetting onto these rolls.

A restriction of such a system is that the speed of the transfer stations, located before the prefuser transport device, and the speed of the fuser station, located after the prefuser transport device, must be substantially equal.

Research Disclosure No. 16249 of December 1977 shows a dielectric belt for transporting copy sheets having unfused toner images on one or both sides. The belt is supported by a first and a second roller, and transports the copy sheet while it is suspended to the belt. The belt is charged by an electrostatic charger, causing an electrostatic attraction force, which tacks the copy sheet to the belt. A neutralising charger, positioned near the second roller, sprays neutralising charges onto the belt. The copy sheet is separated from the belt through the combined effects of neutralisation of the electrostatic attractive force by the neutralising charger, and the sharp bending of the belt about the second roller.

A drawback of this system is that the electrostatic attraction between the belt on the one hand, and the copy sheet containing the toner image on the other hand, may result in toner being transferred from the copy sheet to the belt, thus causing damage to the toner image contacting the belt.

U.S. Pat. No. 5,009,352 describes a conveyor for transporting sheets having an unfused toner image on one side.

The conveyor is charged by an electrostatic charger. The conveyor comprises a dielectric material and electrode parts of a conductive material, in order to create a strong and stable electrostatic field. The electrostatic field causes the sheets to adhere to the conveyor. The conveyor may e.g. be a belt. The conveyor contacts the side of the sheet that does not carry the toner image.

This system is not intended for conveying sheets having unfused toner images on both sides. However, for transporting sheets having unfused toner images on both sides, or for transporting sheets having only one toner image that contacts the conveyor, this system has the same drawback as the previous system—shown in Research Disclosure No. 16249—in that the electrostatic attraction may cause damage to the toner image contacting the conveyor.

U.S. Pat. No. 5,045,892 describes an arrangement to convey paper, having an unfused toner image on one side, from a transfer station to a fusing station. The arrangement comprises a guide member to convey the paper under the control of an electrostatic force. Some of the shown embodiments comprise an endless belt; in the embodiments comprising a belt, the paper is conveyed suspended to the belt, so that the unfused toner image does not contact the belt. The belt is charged by an electrostatic charger so as to attract the paper. At least in the second embodiment, the toner image is attracted to the outer surface of the belt. In some embodiments, the paper may be charged by a second electrostatic charger with an opposite polarity to the belt.

This system is not intended for conveying paper having unfused toner images on both sides, just as the previous system is not. The drawback mentioned above applies to the three last systems described above—i.e. to the systems shown in Research Disclosure No. 16249, in U.S. Pat. No. 5,009,352 and in U.S. Pat. No. 5,045,892—viz. the drawback that the electrostatic attraction may cause damage to a toner image contacting the conveying belt. This is especially important if images of high, near offset quality are to be obtained, as in the present invention.

OBJECTS OF THE INVENTION

It is therefore an object of the invention to transport a receptor support holding a toner image at one or both sides, while minimising damage to this image.

It is a further object of the invention to avoid shocks during the transport of the receptor support, so that, when transporting the receptor support between two stations, e.g. from a transfer station to a fusing station, no interference with the involved steps occurs.

It is still a further object of the invention to allow for speed differences between the stations between which the receptor support is transported.

It is still a further object of the invention to allow for variations of the speed of the receptor support as enforced by the preceding or the following station, e.g. speed variations due to the transfer station drive and/or speed variations due to the fuser station drive.

Further objects of the invention will become apparent from the description hereinafter.

SUMMARY OF THE INVENTION

The above mentioned objects are realised by a system including the specific features according to claim 1. Specific features for preferred embodiments of the invention are set out in the dependent claims.

Further advantages and embodiments of the present invention will become apparent from the following description and drawings.

The sheet-like receptor support may be a sheet of paper, a transparency, etc. The support may also be formed by two sheets back to back, in order to print two single sided sheets simultaneously.

The surface may be realised by an endless belt or by a cylindrical drum. When using a belt, the surface contacting the sheet-like receptor support is preferably rectilinear.

The term "printing" stands in the first place for a printer which creates the output printing image by laying out the image in a series of horizontal scan lines, each line having a given number of pixels per inch. The transport system may however also be used in a copier device, or in whichever system that needs to transport a support carrying particles or powder.

A corotron is a charge generating device, comprising a conductive wire, called corona-wire, and a conductive housing. The corona-wire is charged with respect to the housing, at a tension that exceeds the so-called critical voltage of the surrounding medium, so that this medium, usually air, is partly ionised.

A scorotron comprises a corotron and a grid.

BRIEF DESCRIPTION OF THE DRAWINGS

The invention is described hereinafter by way of examples with reference to the accompanying figures wherein.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the scope of the invention as defined by the appending claims.

Figure 1:
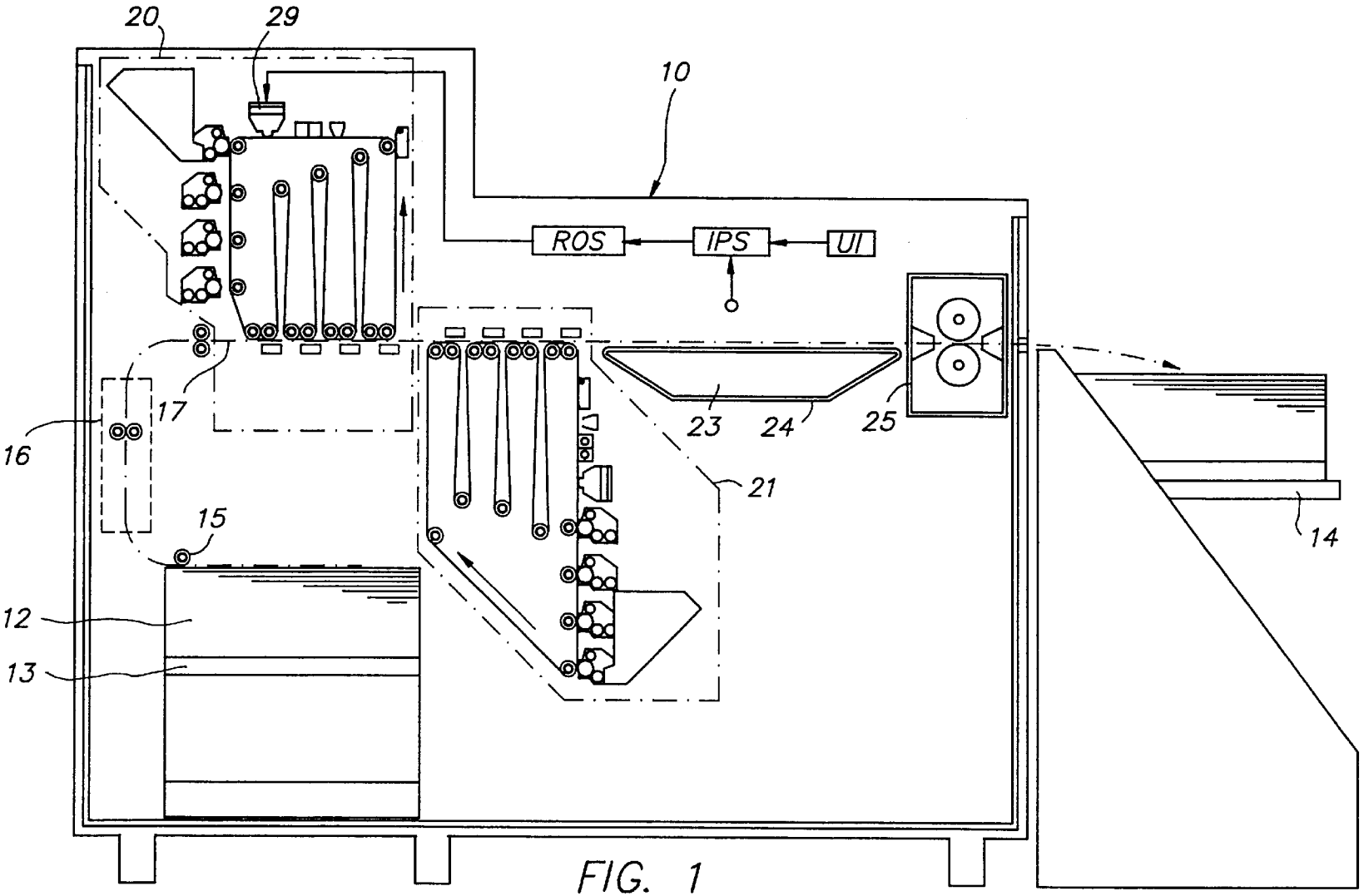
FIG. 1 is a diagrammatic view of an embodiment of a duplex colour printer in accordance with the present invention.

FIG. 1 shows a diagrammatic representation of one embodiment of an electrophotographic duplex colour printer.

The printer comprises a light-tight housing 10 which has at its inside a stack 12 of sheets to be printed, loaded on a platform 13, the height of which is adjusted in accordance with the size of the stack, and at the output side a platform 14 onto which the printed sheets are received.

A sheet to be printed is removed from stack 12 by a dispensing mechanism 15, and passed through an alignment station 16 which ensures the longitudinal and lateral alignment of the sheet.

The following processing stations are located along path 17. A first toner image forming station 20 indicated in a dash-and-dot line for applying a colour toner image to the obverse side of the sheet and a second station 21 for applying a colour toner image to its reverse side. A buffer station 23 with an endless belt 24 for transporting the sheet to fuser station 25 while allowing the speed of the sheet to change because the speed of fusing may be different from that of the speed of toner image formation.

The purpose of buffer 23, also referred to as transport system, is as follows. A fuser station 25 is operating to melt the toner images transferred to the sheets in order to affix them. It will be understood that this operation requires a certain minimum time since the temperature of the fuser is subject to an upper limit which must not be exceeded, otherwise the roller lifetime becomes unsatisfactory. In other words, the speed of fuser station 25 is limited. The speed of the toner image formation stations 20 and 21, on the other hand, is in principle not limited for any particular reason. On the contrary, it is advantageous to use a high speed of toner image formation and toner image transfer, since the four colour separations of each colour image are written by exposure station 29 in succession, which means that the recording time of one colour image amounts to at least four times the recording time of one part image. All this means a relatively high speed of the photoconductive belts, and thus of the synchronously moving sheets, as compared with a maximum usable travelling speed through the fuser station. In the apparatus according to the present embodiment, the speed of the two photoconductive belts amounted to 295 mm/s, whereas the fusing speed was 100 mm/s or less.

Further, it may be desirable to adjust the fusing speed independently from the toner image transfer speed, i.e. the belt speed, for obtaining optimum results. It should be noted that the toner image transfer speed in the imaging stations is preferably constant.

The length of buffer station 23 is preferably sufficient for receiving the largest sheet size to be processed in the apparatus.

Buffer station 23 operating initially at the speed of the photoconductive belts of devices 20 and 21, the speed of this station is reduced to the processing speed of fuser station 25 as the trailing edge of the sheet has left toner image forming station 21.

Fusing station 25 can be of known construction, and can be arranged for radiation or flash fusing, for fusing by convection and/or by pressure, etc. The fused sheet is finally received on platform 14.

In the printing apparatus described hereinbefore, the path of the receptor support, also referred to as sheet, is preferably substantially rectilinear. Therefore, the preferred embodiment of the invention comprises transport means imparting a rectilinear movement to the receptor means, as shown in FIG. 2.

Figure 2:
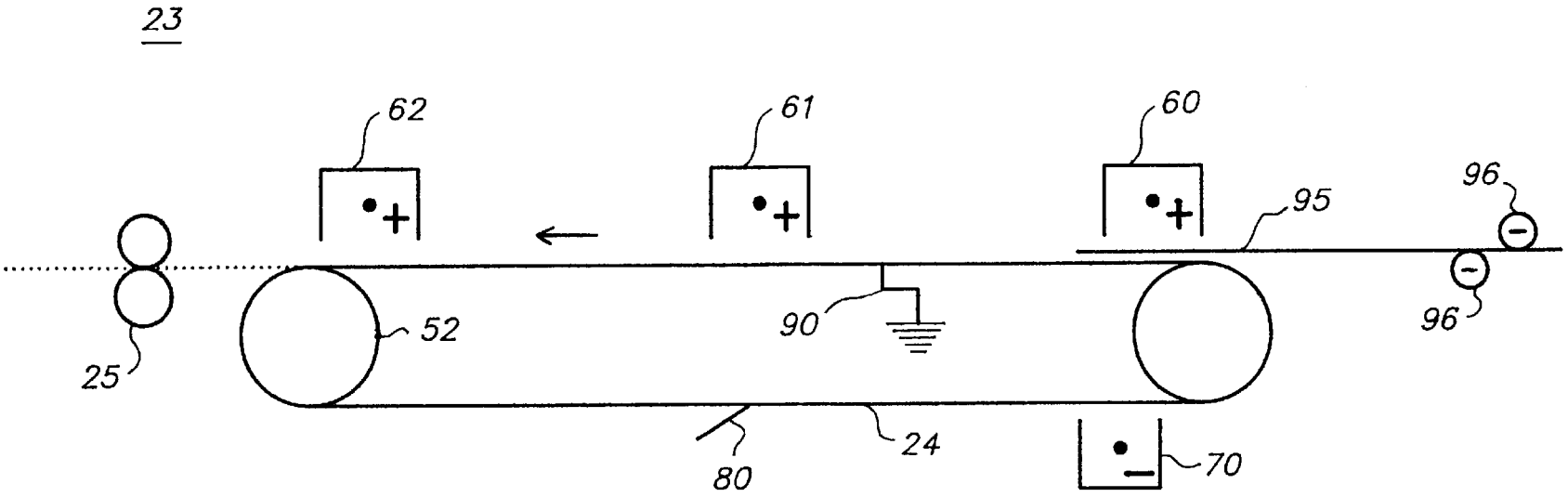
FIG. 2 is a schematic side-view of one embodiment of the invention.

FIG. 2 shows a schematic drawing of a side-view of a preferred embodiment, wherein a belt 24 is supported by rollers 51 and 52. The belt 24 is moved by driving means, not shown, and transports a sheet-like receptor support 95 holding a toner image 96 at each side. Preferably, as explained hereinafter, the belt 24 is grounded by an electric grounding device 90, indicated symbolically in FIG. 2. To prevent toner from being carried over to a subsequent receptor support, preferably a scraper 80 removes the toner from the belt.

Charge generating devices 60 to 62 and 70 spray charges having a polarity as indicated by (+) and (−) respectively; the polarity of the toner charge is indicated by (−). The invention is however not limited to the charge polarities shown in FIG. 2—e.g. in case of a positive (+) toner charge, all charge signs should preferably be reversed, as will become clear from the description hereinafter.

The number of charge generating devices is not limited to that shown in FIG. 2, but can be larger, e.g. 5 or 6, or smaller, e.g. 2. The position of the charge generating devices with respect to the belt can also be different.

The belt 24 can be made of several materials. The surface of the belt, contacting the receptor support, can be conductive or non-conductive. Examples of a belt with a conductive surface include: a metal belt, a polymer belt (e.g. PET) covered with a metal layer (e.g. aluminium) at its outer circumference. In case of a non-conductive surface, the belt preferably comprises at least two layers, of which at least one layer is conductive, while the outer surface layer is non-conductive; examples include: a conductive belt covered with an adhesive material such as polytetrafluoroethylene, e.g., TEFLON, a conductive belt covered with an organic photoconductor. TEFLON is a trade mark of E.I. Du Pont de Nemours and Company.

A non-conductive material is a material having a time constant $\tau=\epsilon^* \rho$ larger than 10 seconds, wherein $\epsilon$ is the dielectrical constant of the material (expressed in F/m in SI-units), and $\rho$ is the electrical resistivity of the material (expressed in Ohms * m in SI-units). A conductive material has a time constant $\tau$ smaller than 10 seconds.

The conductive layer of the belt is preferably electrically grounded, e.g. by a brush 90, as is indicated symbolically in FIG. 2.

As the receptor support contacts the belt, in a preferred embodiment the first charge generating device 60 sprays onto the receptor support charges of the opposite sign to the toner charge, e.g. positive charges (+) are sprayed if the toner charge is negative (−). The function of these charges is twofold: first, attaching the receptor support electrostatically to the belt, and second, increasing the electrostatic force that is attracting the toner image to the receptor support. The first function is important in transporting the receptor support, the second in minimising toner transfer from the receptor support to the belt, and hence minimising damage to the toner image contacting the belt surface, even when there is a slight slip (<4%) between the sheet-like receptor support and the surface of the belt. Spraying charges onto the receptor support of the opposite sign of the toner charge thus offers the important advantage that damage to the toner image is lessened. This is especially important in obtaining images of high, near offset quality.

The function of the charge generating devices 61 and 62 is identical to the function of charge generating device 60.

We have found that the required number of devices 60 to 62 depends on the belt type used. In case of a belt with conductive surface, a maximum time interval between two charge spraying actions is preferably not exceeded. In a preferred embodiment, the distance between two such charge generating devices does not exceed the sheet-length of the support. In a preferred embodiment, the support is electrostatically charged before it contacts the belt surface.

We have also found that the charge generating devices 60 to 62 are preferably set to the lowest possible voltage that still charges the receptor support, as this minimises what is called the "re-transfer" of toner, i.e. the amount of toner carried over from the receptor support to the belt. This can be achieved by driving the charge generating device by a current regulator. We have found that re-transfer from the receptor support to the belt increases with increasing voltage of the charge generating devices 60 to 62. On the other hand, devices 60 to 62 preferably should be set at a minimum voltage, since below this minimum voltage, the receptor support is not charged, which also results in larger re-transfer. Experimental results indicate that charge generating device 60 is preferably set at a voltage between 3.75 kV and 4.50 kV to keep toner re-transfer less than 1%, in the following test set-up: the belt is a metal belt having at its outer circumference a non-conductive layer of 25 $\mu$m of TEFLON; device 60 is a corotron, the distance between the corona-wire and the belt is chosen 11 mm; the receptor support is Agfa 1001 paper; the toner is cyan, the amount of toner is 0.70 mg/cm$^2$; the belt speed is 12.5 cm/s; the relative humidity is 45%.

We have also found, when using a belt with a non-conductive surface, that it is highly advantageous to use a charge generating device 70, having a function differing from the one of the previously described devices 60 to 62: device 70 preferably charges said non-conductive surface with a charge of equal polarity to the toner charge, e.g. negative (−), before the receptor support contacts the belt. If the belt surface is not suitably charged, or if a belt with a conductive surface is used, a relative motion of the receptor support with respect to the belt may cause blurring of the toner image, whereas applying the aforesaid charge to the belt surface has shown to minimise blurring of the toner image, which is an important advantage. A possible cause of said relative motion of the receptor support with respect to the belt can be the following: a large portion of the receptor support has not yet left the station preceding the buffer, and its speed is mainly determined by said preceding station, whereas a speed difference may exist - e.g. because of mechanical tolerances—between the surface of the belt and said preceding station. Another possible cause of said relative motion of the receptor support with respect to the belt can be speed variations due to the transfer station drive and/or speed variations due to the fuser station drive.

Thus, an advantage of the embodiments described above is that good image quality can be obtained, in spite of variations of the speed of the receptor support, as enforced by the preceding (transfer) station or by the following (fuser) station.

Another advantage is that the preceding and the following station may each have an own speed, e.g. a first speed of 295 mm/s for the transfer station and a second speed of 100 mm/s for the fuser station. In fact, as explained hereinbefore, the length of buffer station 23 is preferably sufficient for receiving the largest sheet size to be processed, so that the speed of the buffer station 23 can be reduced—or increased—from the first speed to the second speed.

Because of the flexibility of the belt, and because, as explained above, a relative motion of the receptor support with respect to the belt is allowed, yet another advantage is that shocks are avoided during transport of the receptor support. Thus, no interference occurs with the processing steps in the preceding and the following station.

We also tested surface materials with different adhesion properties with respect to the support material. The speed of the receptor support in the tests was up to 4% larger than the belt speed. These tests have shown that the best image quality is. obtained by using a belt with a very repellant surface, e.g. TEFLON.

In spite of all measures stated above, a small quantity of toner may still adhere to the belt after the receptor support has left it. To prevent said toner from being carried over to a subsequent receptor support, preferably a scraper 80 removes the toner from the belt. Various materials can be used for the scraper blade, e.g. polyurethane. In a preferred embodiment, the scraper blade is pressed against the belt: the force exerted onto the scraper should be large enough, yet not too large, for optimal contact between scraper blade and belt, and hence for optimal belt cleaning results. In a test, a force of 24 N/m exerted onto the scraper gave excellent cleaning results, while toner was left on the belt when using a force smaller than 12 N/m—too small a force for good contact—and while a force larger than 30 N/m left longitudinal stripes on the belt, due to the fact that the scraper was bent by this large force, and thus did not contact the belt well enough over the complete scraper blade length. Hence, the contacting force is preferably chosen between 12 and 30 N/m.

A first preferred embodiment is the one corresponding to FIG. 2, in which four charge generating devices 60, 61, 62 and 70 are used, and in which the belt is a metal belt.

A second, more preferred embodiment, also corresponds to FIG. 2, but here only two charge generating devices 60 and 70 are used, while the belt comprises a conductive layer covered with a non-conductive outer surface layer, e.g. an organic photoconductor.

A third, still more preferred embodiment, also corresponds to FIG. 2. Only two charge generating devices 60 and 70 are used and the belt comprises a conductive layer, covered with a non-conductive outer surface layer that is very repellent e.g. TEFLON.

The following example illustrates the most preferred embodiment: Belt 24 was a metal belt, with an outer surface layer of 25 $\mu$m TEFLON. The belt supporting rollers 51 and 52 had a diameter of 32 mm. The speed was variable between 60 mm/s and 295 mm/s. The charge generating device 60 was a corotron; the distance from corona-wire to belt was 11 mm, the voltage of the corona-wire was 4 kV. The charge generating device 70 was a scorotron; the grid distance was 1 mm. The scraper 80 was formed by a Hokushin Sealingblade, made of polyurethane, type 237900, with a hardness of 70 Shore A. A force was exerted between scraper and belt of 24 N/m.

Having described in detail preferred embodiments of the current invention, it will now be apparent to those skilled in the art that numerous modifications can be made therein without departing from the scope of the invention as defined in the following claims.

Parts list

10 housing
12 sheet stack
13 platform
14 platform
15 dispenser
16 aligner
17 sheet path
20 image forming station
21 image forming station
23 buffer station
24 transport belt
25 fuser
29 exposure station
51 belt supporting roller
52 belt supporting roller
60 charge generating device
61 charge generating device
62 charge generating device
70 charge generating device
80 scraper
90 electric grounding device, indicated symbolically
95 receptor support holding a toner image at each side
96 toner particles

We claim:

1. A transport system for transporting a sheet-like receptor support carrying particles having an electrostatic particle charge, said electrostatic particle charge having a polarity, the transport system comprising:

a surface on the transport system for making contact with the support and for transporting the support;

a first charge generating device for applying first electrostatic charges to the support and establishing an electrostatic attraction between the support and the surface to adhere said particles to said support during transport, the first electrostatic charges having a polarity opposite to the polarity of the electrostatic particle charge.

2. The transport system according to claim 1, wherein the first charge generating device comprises means for applying the first electrostatic charges to the support before the support contacts the surface.

3. The transport system according to claim 1, further comprising a plurality of first charge generating devices, at a mutual distance not greater than a minimum length of the support.

4. The transport system according to claim 1, wherein the particles are toner particles having an electrostatic toner charge.

5. The transport system according to claim 1, comprising a second charge generating device for applying second electrostatic charges to the surface, thereby establishing an electrostatic attraction between the support and the surface.

6. The transport system according to claim 5, wherein the second charge generating device is a corotron.

7. The transport system according to claim 5, wherein the second charge generating device is a scorotron.

8. The transport system according to claim 5, wherein the second electrostatic charges have a polarity equal to the polarity of the electrostatic particle charge.

9. The transport system according to claim 1, wherein said surface is a belt comprising:

a conductive layer; and a non-conductive layer covering the conductive layer for contacting the support.

10. The transport system according to claim 9, further comprising means for electrically grounding the conductive layer.

11. The transport system according to claim 9, wherein the non-conductive layer comprises a repellent material.

12. The transport system according to claim 1, wherein the support carries the particles on both sides thereof.

13. The transport system according to claim 1, further comprising driver means for driving the surface at a variable speed.

14. The transport system according to claim 6, wherein said corotron comprises a current regulator.

15. The transport system according to claim 7, wherein said scorotron comprises a current regulator.

16. The transport system according to claim 11, wherein said repellent material is Teflon.

* * * * *